US006186346B1

(12) United States Patent
Reitz

(10) Patent No.: US 6,186,346 B1
(45) **Date of Patent: *Feb. 13, 2001**

(54) MULTI-POSITION LOW PROFILE BOOM NOSE

(75) Inventor: Eric L. Reitz, Waynesboro, PA (US)

(73) Assignee: Grove U.S. L.L.C., Shady Grove, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/044,751

(22) Filed: Mar. 20, 1998

(51) Int. Cl.[7] ..... B66C 23/04
(52) U.S. Cl. ..... 212/168; 212/347; 212/300
(58) Field of Search ..... 212/168, 274, 212/299, 300, 231, 347

(56) References Cited

U.S. PATENT DOCUMENTS

| | | | | |
|---|---|---|---|---|
| Re. 27,763 | | 9/1973 | Fauchere . | |
| 1,182,387 | * | 5/1916 | Kothe . | |
| 2,805,781 | * | 9/1957 | Senn | 212/274 |
| 3,028,018 | * | 4/1962 | Mott | 212/300 |
| 3,085,695 | * | 4/1963 | Miller | 212/300 |
| 3,349,925 | | 10/1967 | Waerum et al. . | |
| 3,516,554 | | 6/1970 | Nakamura . | |
| 3,572,517 | * | 3/1971 | Liebherr et al. | 212/300 |
| 3,620,504 | * | 11/1971 | Morrison | 212/274 |
| 3,754,666 | * | 8/1973 | Suverkrop | 212/300 |
| 3,757,959 | | 9/1973 | Thompson et al. . | |
| 3,829,992 | | 8/1974 | Reid et al. . | |
| 3,885,677 | * | 5/1975 | Gorl et al. | 212/299 |
| 3,959,899 | | 6/1976 | Rangaswamy . | |
| 4,222,492 | * | 9/1980 | Wuerflein et al. | 212/300 |
| 4,241,837 | * | 12/1980 | Suverkrop | 212/231 |
| 4,343,458 | | 8/1982 | Simon . | |
| 4,828,124 | * | 5/1989 | Iga | 212/300 |
| 5,542,812 | | 8/1996 | Grove et al. . | |

FOREIGN PATENT DOCUMENTS

| | | | | |
|---|---|---|---|---|
| 291531 | * | 7/1991 | (DE) | 212/300 |
| 59-176886 | | 11/1984 | (JP) . | |
| 64-018091 | | 1/1989 | (JP) . | |
| 07-010474 | | 1/1995 | (JP) . | |
| 09-249378 | | 9/1997 | (JP) . | |
| 1288151 | * | 2/1987 | (SU) | 212/300 |

OTHER PUBLICATIONS

Lift Equipment, "Shuttlelift debuts new carrydeck crane", Apr.–May 1998, p. 51.

* cited by examiner

*Primary Examiner*—Thomas J. Brahan
(74) *Attorney, Agent, or Firm*—Birch, Stewart, Kolasch & Birch, LLP

(57) ABSTRACT

A multi-position boom nose includes a support structure disposed at one end of a boom. The support structure supports at least a first sheave set, and the first sheave set includes at least one sheave. A pivot arm has a first end pivotally connected to the support structure. A second end of the pivot arm supports a second sheave set, and the second sheave set includes at least one sheave. The pivot arm has a first working position, a second working position and a stowed position. The pivot arm extends towards the boom in the stowed position. Specifically, the pivot arm extends into the boom in the stowed position. In the first working position, the pivot arm extends perpendicular to the boom. In the second working position, the pivot arm extends away from the boom, and the first sheave set supports a first load bearing member, while the second sheave set supports a second load bearing member.

20 Claims, 4 Drawing Sheets

MULTI-POSITION LOW PROFILE BOOM NOSE

BACKGROUND OF THE INVENTION

1. Field of the Invention

The present invention relates to the nose of a boom; and more particularly, a multi-position low profile boom nose.

2. Description of Related Art

The nose of a boom, multi-section or otherwise, is typically a welded steel structure that houses and provides support for one or more sheaves mounted to a shaft, and is used to redirect a lifting or load line around the point end of the boom to the load. Boom nose sheaves may be mounted to one single shaft at one location, but often there is an upper sheave assembly and a lower sheave assembly. The upper or primary sheave directs the load or lifting line around the end of the boom to a lower or secondary sheave assembly (i.e., lower boom nose sheave, auxiliary boom nose sheave, boom extension sheave). The secondary sheave assembly is necessary to accommodate multiple parts of line required when loads, which are greater than the allowable limit for one or two parts of line, are lifted. If no loads will be lifted that exceed the allowable limit for two parts of line, then one sheave location is sufficient.

When multiple parts of line are required, a hookblock is used to lift the load. A hookblock is a lifting device consisting of one or more sheaves enclosed in a steel housing with a hook at the bottom used for grabbing the load. For two parts of line, the wire rope must pass over the lower sheave on the boom nose, continue down around the hookblock sheave, and then return back again to the boom nose where it is attached to a dead end lug. For three or more parts of line, an appropriate number of lower boom nose sheaves and hookblock sheaves are required, and the load line is reeved back and forth between the two until the number of parts of line is obtained.

When lifting loads using multiple parts of line at high boom angles, the return lines from the hookblock to the lower boom nose sheaves must clear the bottom of the boom sections. This requires that the boom nose extend below the bottom of the boom to accommodate the necessary location of the lower boom nose sheaves. Thus, the overall height of the boom nose becomes greater than desirable as it reduces the height a load may be lifted.

A compact boom nose is an important feature when lifting loads in confined areas where accessibility is limited. However, it is also desirable that the maximum lifting capability not be compromised.

SUMMARY OF THE INVENTION

An object of the present invention is to provide a multi-position boom nose which overcomes the problems and disadvantages discussed above.

A further object of the present invention is to provide a compact boom nose.

A still further object of the present invention is to provide a multi-position low profile boom nose having a primary and secondary sheave set with the secondary sheave set being stowable.

Another object of the present invention is to provide a boom nose which is compact and maximizes lifting capabilities.

Also an object of the present invention is to provide a multi-position boom nose having primary and secondary sheave sets with the secondary sheave set being positionable such that both the primary and second sheave sets can each support a load bearing member.

These and other objectives are provided by a multiposition boom nose, comprising: a support structure disposed at one end of a boom and supporting at least a first sheave set, said first sheave set including at least one sheave; a pivot arm having a first and second end, said first end pivotally connected to said support structure, said second end supporting a second sheave set, said second sheave set including at least one sheave, said pivot arm having at least a first working position and a stowed position, said pivot arm extending towards said boom in said stowed position.

These and other objectives are further provided by a multi-position boom nose, comprising: a support structure disposed at one end of a boom and supporting at least a first sheave set, said first sheave set including at least one sheave; a first load bearing means for bearing a load; a second load bearing means for bearing a load; a pivot arm having a first and second end, said first end pivotally connected to said support structure, said second end supporting a second sheave set, said second sheave set including at least one sheave, said pivot arm having at least a first working position and a second working position, said first load bearing means being supported by said first sheave set and said second load bearing means being supported by said second sheave set when said pivot arm is in said second working position.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
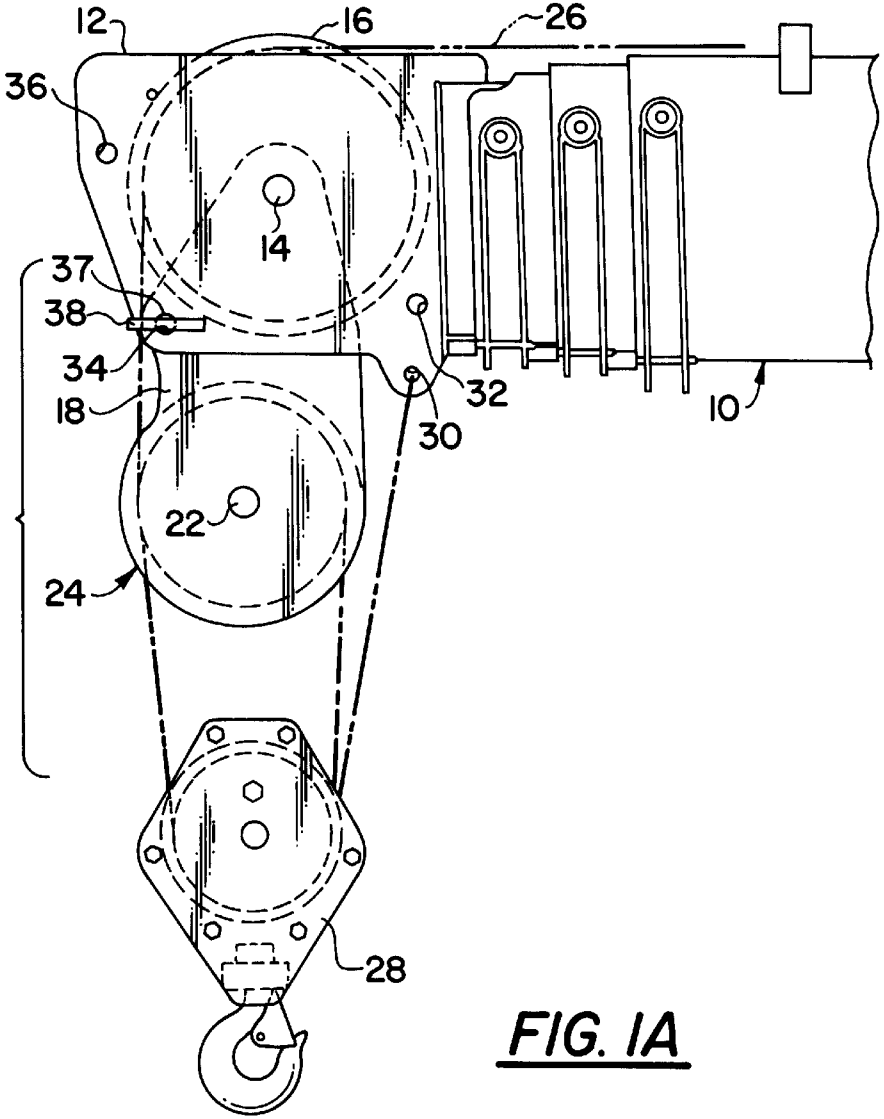
FIGS. 1A and 1B illustrate a side view and an end view, respectively, of an embodiment of the boom nose according to the present invention in a full boom nose configuration.
Figure 1B:
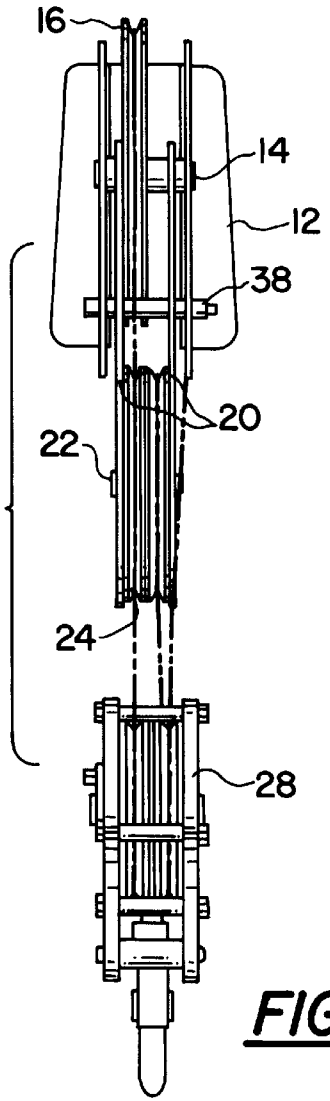

FIGS. 1A and 1B illustrate a side view and an end view, respectively, of an embodiment of the boom nose according to the present invention in a full boom nose configuration. As shown in FIGS. 1A and 1B, a boom nose 12 is disposed at the end of a multi-section boom 10. The boom nose 12 is a support structure for supporting a primary set of sheaves 16 on a first shaft 14. The boom nose 12 also supports a pivot arm 18 on first shaft 14.

As shown in FIG. 1B, the pivot arm 18 is formed of two parallel plates 20 and a second shaft 22. The pivot arm 18 supports a secondary set of sheaves 24 on the second shaft 22. Each of the primary sheave set 16 and the secondary sheave set 24 includes at least one sheave. As shown in FIG. 1B, the embodiment of the boom nose according to the present invention illustrated therein includes one sheave in the primary sheave set 16, and two sheaves in the secondary sheave set 24.

A hoist load line 26 connected to a hoist (not shown) is reeved along the primary and secondary sheave sets 16 and 24 and a hookblock 28. The end of the load line 26 is attached to the boom nose 12 by a dead end lug 30.

As discussed above, the pivot arm 18 is pivotally connected to the boom nose 12 at the first shaft 14. Accordingly, by pivoting the pivot arm 18 about the first shaft 14, the secondary sheave set 24 can be disposed in one of several positions. As further shown in FIG. 1A, the boom nose 1, includes a first mounting hole 32 formed in a lower right hand corner, a second mounting hole 34 formed in a lower left hand corner, and a third mounting hole 36 formed in an upper left hand corner. The pivot arm 18 also includes a fourth mounting hole 37 formed therein. By positioning a locking pin 38 in the fourth mounting hole 37 and the second mounting hole 34 as shown in FIG. 1A, the pivot arm 18 is locked perpendicular to the boom 10. This position is referred to as the full boom nose configuration.

The full boom configuration is used to lift any load which requires three or more parts of line. In addition, the full boom nose configuration can be used anytime that a compact boom nose is not a requirement.

By pivoting the pivot arm 18 upwards and disposing the locking pin 38 in the fourth mounting hole 37 and the third mounting hole 36, the pivot arm 18 can be locked such that the pivot arm 18 extends away from the boom 10. In this position, referred to as the auxiliary boom nose configuration, the pivot arm 18 forms an obtuse angle with the boom 10.

Figure 2A:
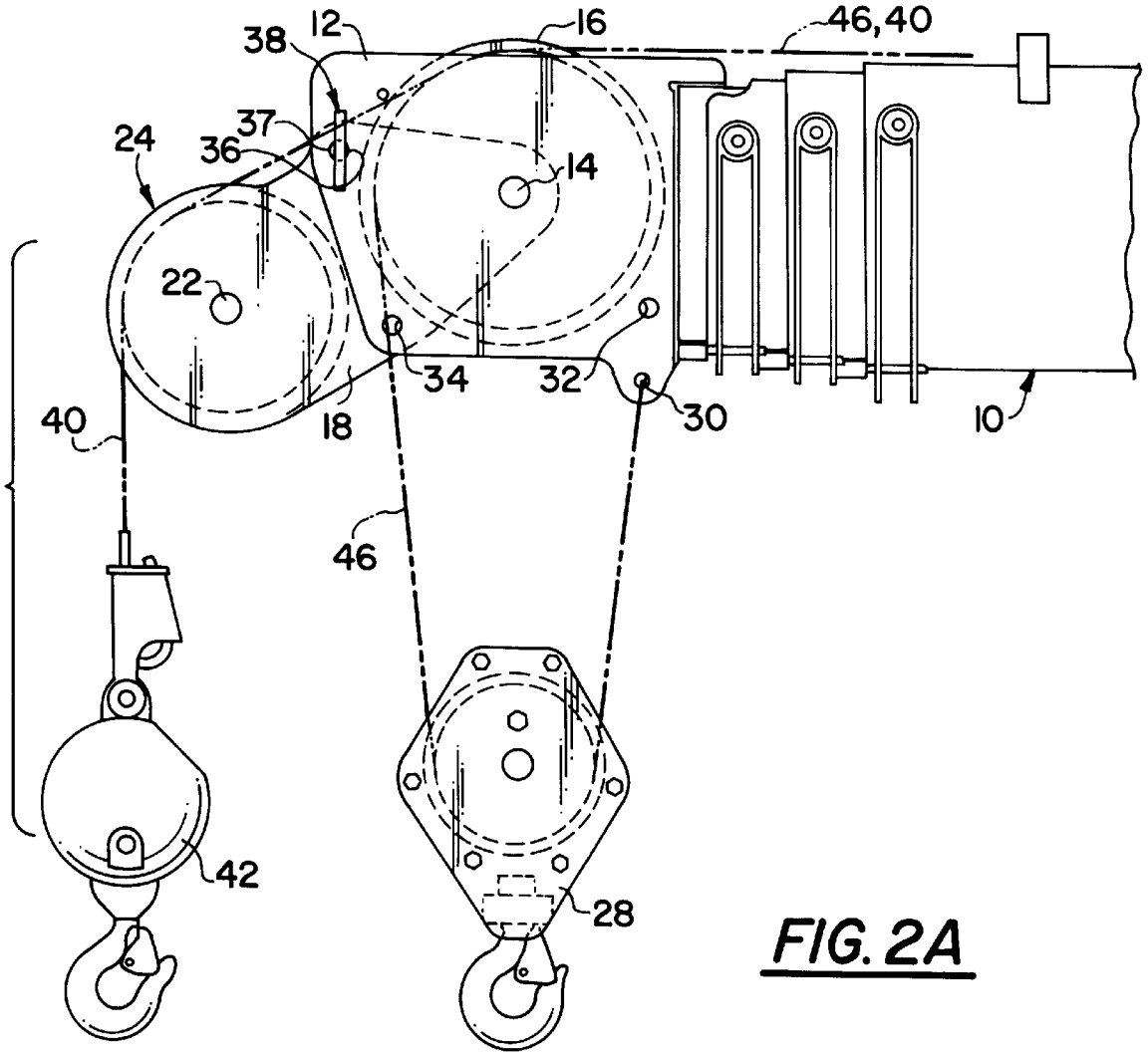
FIGS. 2A and 2B illustrate a side view and an end view, respectively, of the embodiment of the boom nose according to the present invention in an auxiliary boom nose configuration and supporting two load bearing members.
Figure 2B:
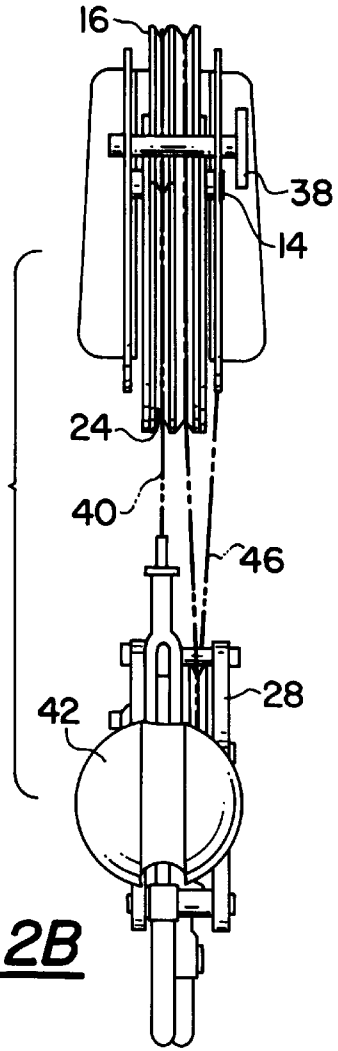

FIGS. 2A and 2B illustrate a side view and an end view, respectively, of the embodiment of the boom nose according to the present invention in the auxiliary boom nose configuration. As shown in FIGS. 2A and 2B, in the auxiliary boom nose configuration, a main hoist load line 46, connected to a main hoist (not shown), is reeved about the primary sheave set 16 and the hookblock 28. The end of the main hoist load line 46 is attached to the boom nose 12 using the dead end lug 30. Furthermore, an auxiliary hoist load line 40, connected to an auxiliary hoist (not shown), is reeved on both the primary sheave set 16 and the second sheave set 24. The end of the auxiliary hoist load line 40 is attached to a headache ball 42. Consequently, when in the auxiliary boom nose configuration, both the main and auxiliary hoist load lines 46 and 40 could be used at the same time.

Figure 3A:
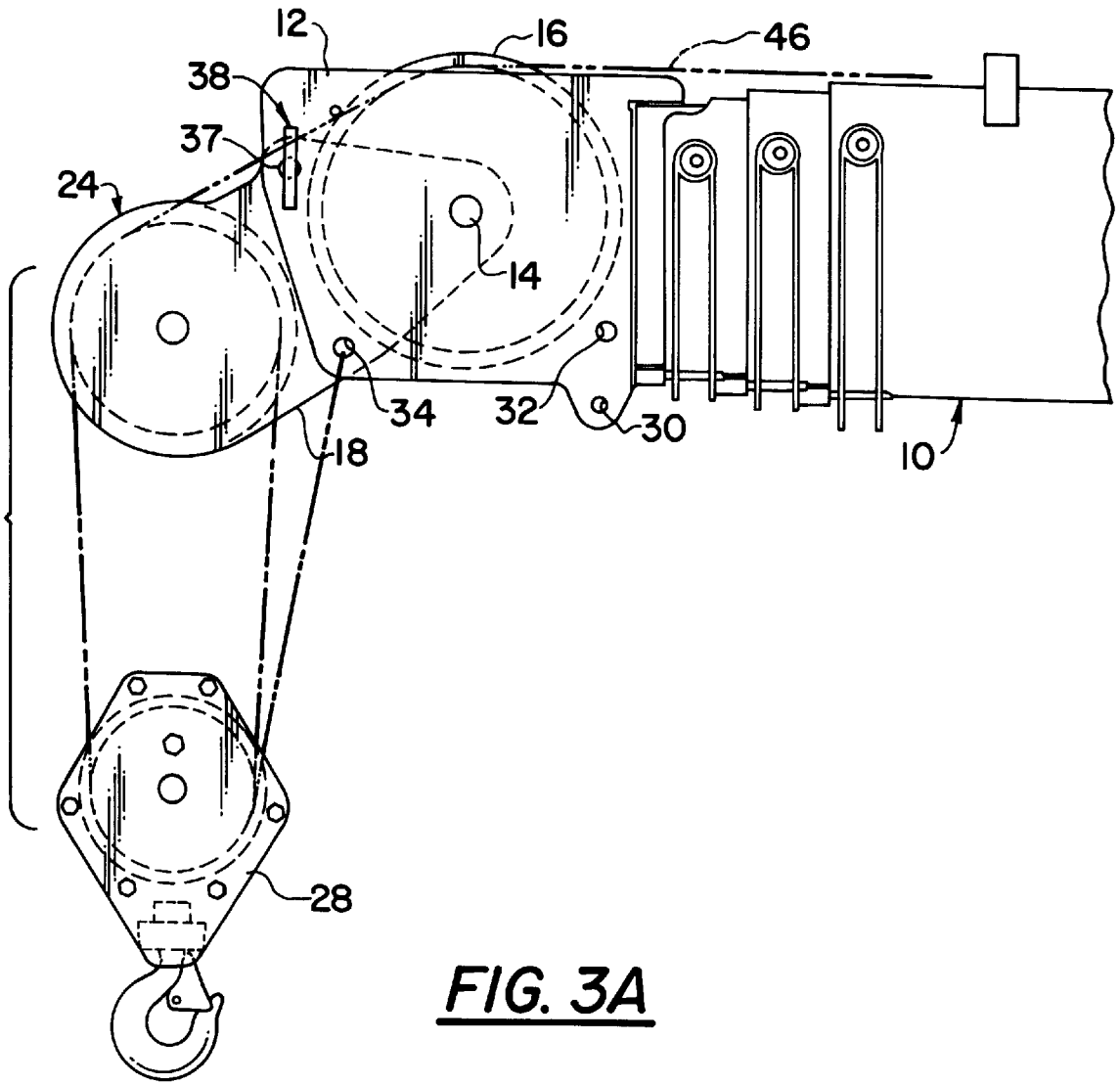
FIGS. 3A and 3B illustrate a side view and an end view, respectively, of the embodiment of the boom nose according to the present invention in the auxiliary boom nose configuration and supporting a single load bearing member.
Figure 3B:
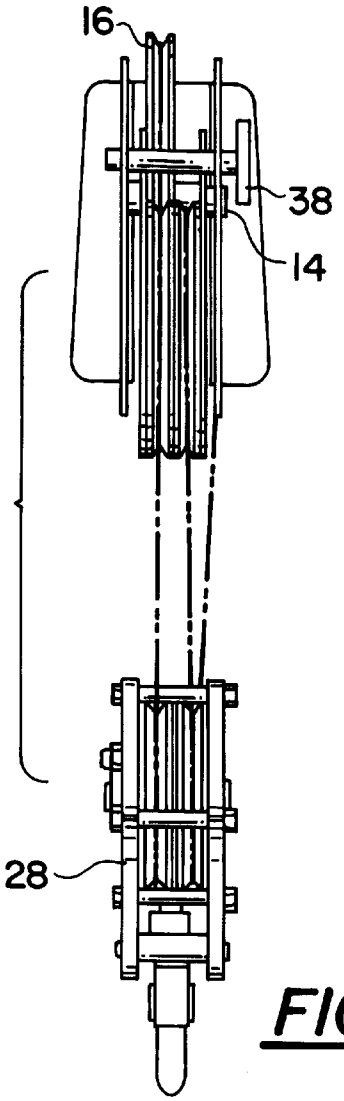

In addition, there is a second option for the auxiliary boom nose configuration. FIGS. 3A and 3B illustrate a side view and an end view, respectively, of this second option. With the main hoist load line 46 reeved in the full boom nose configuration of FIGS. 1A and 1B, a switch to the auxiliary boom nose configuration can be easily accomplished by pulling the locking pin 38, rotating the pivot arm 18 into the auxiliary boom nose configuration, and reinstalling the locking pin in the fourth and third mounting holes 37 and 36. This will provide additional boom length, reduce boom nose height, and can be accomplished without unreeving the main hoist load line 46.

Figure 4A:
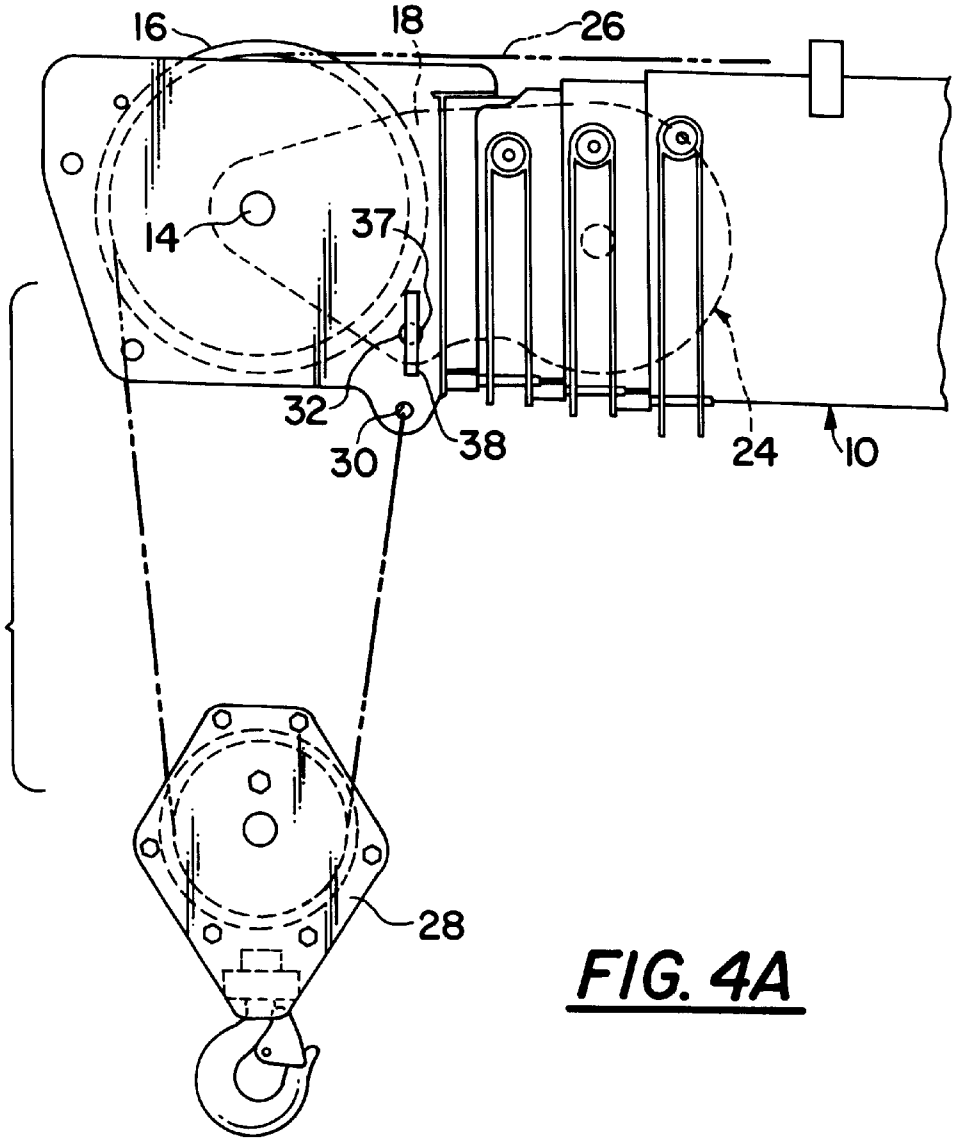
FIGS. 4A and 4B illustrate a side view and an end view, respectively, of the embodiment of the boom nose according to the present invention in a compact or stowed boom nose configuration.
Figure 4B:
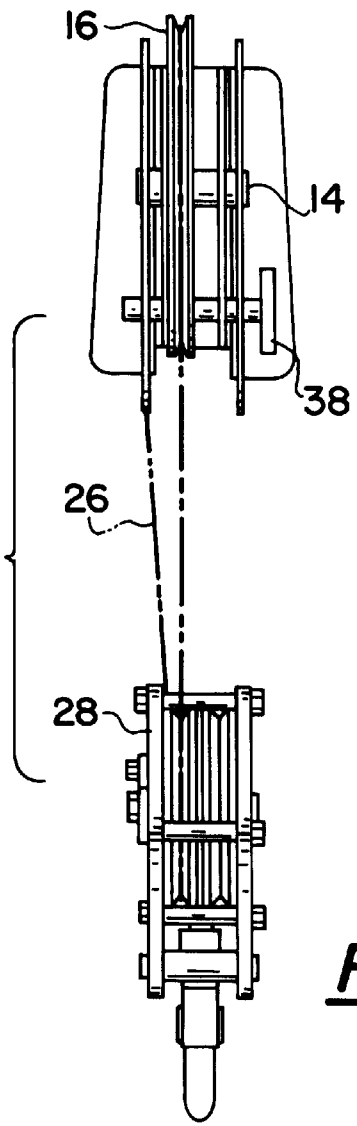

With the fly section of the boom 10 partially extended, the pivot arm 18 is rotated towards the boom 10 until the pivot arm 18 extends towards the boom 10. The pivot arm 18 can then be locked in this position, referred to as the compact boom nose or stowed boom nose configuration, by inserting the locking pin 38 in the fourth mounting hole 37 and the first mounting hole 32. FIGS. 4A and 4B illustrate a side view and an end view, respectively, of the stowed boom nose configuration. As shown in FIG. 4A, retracting the fly section of the boom 10 causes the pivot arm 18 with the secondary sheave set 24 attached thereto to extend into the boom 10. In the stowed boom nose configuration, the hoist load line 26 is reeved on the primary sheave set 16 and the hook block 28, and the end thereof is attached to the boom nose 12 by the dead end lug 30.

The compact or stowed boom nose configuration can be used when one or two parts of line are required to lift a load and it is desirable to have the ability to increase the elevation of the load without increasing the elevation of the boom when working in a confined area.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A combination comprising:

a boom having a distal end;

a support structure connected adjacent said distal end of said boom;

a first sheave set supported by said support structure, said first sheave set including at least one sheave;

a pivot arm having a first end and a second end, a portion of said pivot arm, adjacent said first end of said pivot arm, being pivotally attached to said support structure about a pivot axis, wherein said pivot arm is rotated about said pivot axis a first degree of rotation to a first working position and rotated about said pivot axis a second degree of rotation to a stowed position; and a second sheave set supported adjacent said second end of said pivot arm, said second sheave set including at least one sheave, wherein said second sheave set is contained within said boom when said pivot arm is in said stowed position.

2. The combination according to claim 1, wherein said boom has a longitudinal extension direction, and wherein said first degree of rotation is substantially ninety degrees relative to said longitudinal extension direction.

3. The combination according to claim 2, wherein said second degree of rotation is substantially zero degrees relative to said longitudinal extension direction.

4. The combination according to claim 3, wherein said pivot arm is rotated about said pivot axis a third degree of rotation to a second working position.

5. The combination according to claim 4, wherein said third degree of rotation corresponds to an obtuse angle relative to said longitudinal extension direction.

6. The combination according to claim 1, wherein said boom is an extensible boom including a plurality of sections.

7. The combination according to claim 1, further comprising:

a cable, said cable engaging said at least one sheave of said first sheave set and said at least one sheave of said second sheave set when said pivot arm is in said first working position, said cable engaging said at least one sheave of said first sheave set but not engaging said at least one sheave of said second sheave set when said pivot arm is in said stowed position.

8. The boom nose of claim 1, wherein said at least one sheave of said first sheave set has an axis of rotation, and said pivot axis of said pivot arm is collinear with said axis of rotation.

9. A combination comprising:

a boom having a distal end;

a support structure connected adjacent said distal end of said boom, said support structure including a first alignment feature;

a first sheave set supported by said support structure, said first sheave set including at least one sheave;

a pivot arm having a first end and a second end, a point adjacent said first end of said pivot arm being pivotally attached to said support structure, said pivot arm including a second alignment feature, wherein said pivot arm is rotated about said pivot axis a first degree of rotation to a first working position and rotated about said pivot axis a second degree of rotation to a stowed position;

a second sheave set supported adjacent said second end of said pivot arm, said second sheave set including at least one sheave, wherein at least a portion of said second sheave set is positioned inside said boom when said pivot arm is in said stowed position; and a member for cooperating with said first and second alignment features to lock said pivot arm into either of said first working position or said stowed position.

10. The combination according to claim 9, wherein said at least one sheave of said first sheave set has an axis of rotation, and said pivot axis of said pivot arm is collinear with said axis of rotation.

11. The combination according to claim 9, wherein said boom is an extensible boom including a plurality of sections.

12. The combination according to claim 9, further comprising:

a cable, said cable engaging said at least one sheave of said first sheave set and said at least one sheave of said second sheave set when said pivot arm is in said first working position, said cable engaging said at least one sheave of said first sheave set but not engaging said at least one sheave of said second sheave set when said pivot arm is in said stowed position.

13. The boom nose of claim 9, wherein said first alignment feature includes a first hole and a second hole formed in said support structure;

said second alignment feature includes a third hole formed in said pivot arm; and said member includes a locking pin, wherein said locking pin is disposed in said first and third holes to lock said pivot arm in said stowed position, and disposed in said second and third holes to lock said pivot arm in said first working position.

14. The combination according to claim 9, wherein said boom has a longitudinal extension direction, and wherein said first degree of rotation is substantially ninety degrees relative to said longitudinal extension direction.

15. The combination according to claim 14, wherein said second degree of rotation is substantially zero degrees relative to said longitudinal extension direction.

16. The combination according to claim 15, wherein said pivot arm is rotated about said pivot axis a third degree of rotation to a second working position.

17. The combination according to claim 16, wherein said third degree of rotation corresponds to an obtuse angle relative to said longitudinal extension direction.

18. The boom nose of claim 17, wherein a first load bearing means is supported by said first sheave set and a second load bearing means is supported by said second sheave set when said pivot arm is in said second working position.

19. The boom nose of claim 9, wherein said first alignment feature includes a first hole, a second hole, and a third hole formed in said support structure;

said second alignment feature includes a fourth hole formed in said pivot arm; and said member includes a locking pin, wherein said locking pin is disposed in said first and fourth holes to lock said pivot arm in said stowed position, disposed in said second and fourth holes to lock said pivot arm in said first working position, and disposed in said third and fourth holes to lock said pivot arm in a second working position.

20. The boom nose of claim 19, wherein said at least one sheave of said first sheave set has an axis of rotation, and said pivot axis of said pivot arm is collinear with said axis of rotation.

* * * * *